US005772684A

United States Patent [19]

Shrock

[11] Patent Number: 5,772,684

[45] Date of Patent: Jun. 30, 1998

[54] MUSICAL PACIFIER

[76] Inventor: Richard A. Shrock, c/o JASB, Inc., 850 Church Rd., Elgin, Ill. 60123-9344

[21] Appl. No.: 457,615

[22] Filed: Jun. 1, 1995

[51] Int. Cl.[6] ..... A61J 17/00

[52] U.S. Cl. ..... 606/236; 606/234

[58] Field of Search ..... 606/234–236; D24/194–199; 215/11.1–11.6; 200/512, 515

[56] References Cited

U.S. PATENT DOCUMENTS

| | | |
|---|---|---|
| 4,554,919 | 11/1985 | Hubert . |
| 4,586,621 | 5/1986 | Dahan . |
| 4,726,376 | 2/1988 | Dahan . |
| 4,768,510 | 9/1988 | Leung . |
| 4,856,519 | 8/1989 | Teves . |
| 5,109,864 | 5/1992 | Lu . |
| 5,292,335 | 3/1994 | Shin . |

FOREIGN PATENT DOCUMENTS 0185614 3/1990 European Pat. Off. .

*Primary Examiner*—Glenn K. Dawson

*Attorney, Agent, or Firm*—Wood, Phillips, VanSanten, Clark & Mortimer

[57] ABSTRACT

A watertight, immersion proof musical pacifier includes a mouthpiece including a faceguard having a central opening defining an air passage to an integral sealed housing. A nipple has an interior space. A plug sealingly mounts the nipple to the mouthpiece with the interior space in communication with the housing through the air passage. A switch-actuated sound generating circuit disposed in the housing controllably reproduces audio signals. A pressure sensitive switch normally closes the air passage. The switch electrically actuates the sound generating circuit in response to pressure generated in the nipple. An air leakage path between the nipple interior space and the housing to maintain static pressure equilibrium between the nipple interior space and the housing.

22 Claims, 3 Drawing Sheets

MUSICAL PACIFIER

FIELD OF THE INVENTION

This invention relates to a musical pacifier and, more particularly, to a pacifier which maintains static pressure equilibrium between a nipple and a housing for an electronic circuit.

BACKGROUND OF THE INVENTION

A pacifier, as its name suggests, is often used by parents to pacify an infant. The typical pacifier includes a plastic mouthpiece having a faceguard. A flexible nipple is secured to the faceguard. A handle or the like is often provided for the infant or parent to grasp the pacifier.

More recently, musical pacifiers have been developed in which the mouthpiece includes a casing or housing for an electronic programmed circuit which is switchable to produce an audible sound, such as a musical tune. In one known form the switch comprises a diaphragm switch overlying an opening between the nipple and the housing. As is known with diaphragm operation, a pressure differential causes movement of the diaphragm. The pressure differential is produced when the infant sucks on the nipple, causing an increased pressure on the nipple side of the diaphragm resulting in movement of the diaphragm to close an electrical switch. The switch closure triggers the programmed circuit to produce a musical tune played through a miniature speaker.

An important concern with parents is cleanliness of an infant's pacifier. It is not unusual for the pacifier to fall on the floor and thus become contaminated, or to be picked up by other persons which might transfer bacteria to the nipple. A pacifier is typically sterilized by placing it in boiling water or into a dishwasher.

With a musical pacifier, additional concerns exist with respect to sterilization due to possible damage to the electronic components. Either the pacifier must be made watertight and immersion proof or be disposable. If the pacifier is watertight and immersion proof, then it can be placed in water. However, a diaphragm type switch may rupture if a large differential pressure develops across it. This can occur if the air on one side of the diaphragm switch heats up faster than the air on the other side when the pacifier is boiled, sterilized, or washed in a dishwasher.

Likewise, a change in atmospheric pressure or altitude will compress or expand the nipple and place a bias on the diaphragm switch. The bias consists of a change in the distance of the conductive material on the diaphragm switch from the contacts on the printed circuit board. The switch may then be harder to activate by the infant or the switch may be activated inadvertently for long periods of time, leading to premature battery failure.

The present invention is directed to overcoming one or more of the problems discussed above in a novel and simple manner.

SUMMARY OF THE INVENTION

In accordance with the invention there is disclosed a musical pacifier adapted to prevent damage from a large differential pressure across a switch and to prevent switch bias due to changes in ambient pressure and temperature.

Broadly, there is disclosed herein a musical pacifier comprising a mouthpiece including a faceguard having a central opening defining an air passage to an integral housing. A nipple is mounted to the mouthpiece and has an interior space in communication with the housing through the air passage. A switch actuated sound generating circuit is disposed in the housing for controllably reproducing audio signals. A pressure sensitive switch normally closes the air passage. The switch electrically actuates the sound generating circuit in response to pressure generated in the nipple. Means defining an air leakage path between the nipple interior space and the housing maintains static pressure equilibrium between the nipple interior space and the housing.

In accordance with one aspect of the invention the switch comprises a diaphragm switch. The diaphragm switch is a flexible, electrically conducting element spaced a select distance from contacts associated with the sound generating circuit. The element includes a raised annular ridge normally spacing the element from the contacts.

In accordance with another aspect of the invention, the housing comprises a sealed housing.

In accordance with a further aspect of the invention, a plug secures the nipple in the central opening of the mouthpiece. The plug includes a through opening defining an air passage between the nipple and the housing which is normally closed by the switch. The air leakage means comprises a channel in the plug defining a bypass path around the switch.

In accordance with another aspect of the invention, the air leakage means comprises a through opening in the switch.

In accordance with a further aspect of the invention there is disclosed a watertight, immersion proof musical pacifier comprising a mouthpiece including a faceguard having a central opening defining an air passage to an integral sealed housing. A nipple has an interior space. Means sealingly mount the nipple to the mouthpiece with the interior space in communication with the housing through the air passage. A switch-actuated sound generating circuit disposed in the housing controllably reproduces audio signals. A pressure sensitive switch normally closes the air passage. The switch electrically actuates the sound generating circuit in response to pressure generated in the nipple. Means defining an air leakage path between the nipple interior space and the housing equalizes pressure in the nipple interior space and the housing.

Further features and advantages of the invention will be readily apparent from the specification and from the drawing.

DETAILED DESCRIPTION OF THE INVENTION

Figure 1:
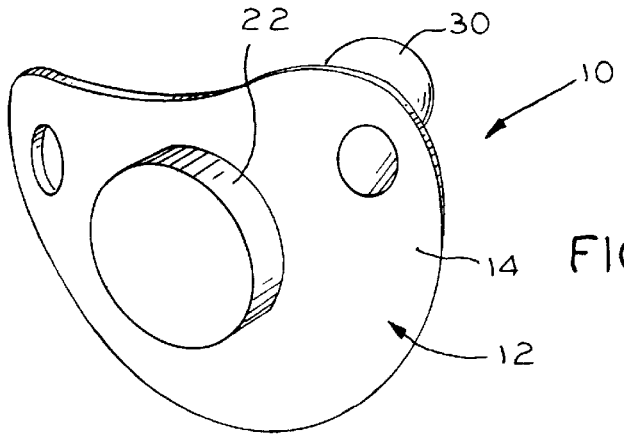
FIG. 1 is a perspective view of a musical pacifier according to the invention.
Figure 2:
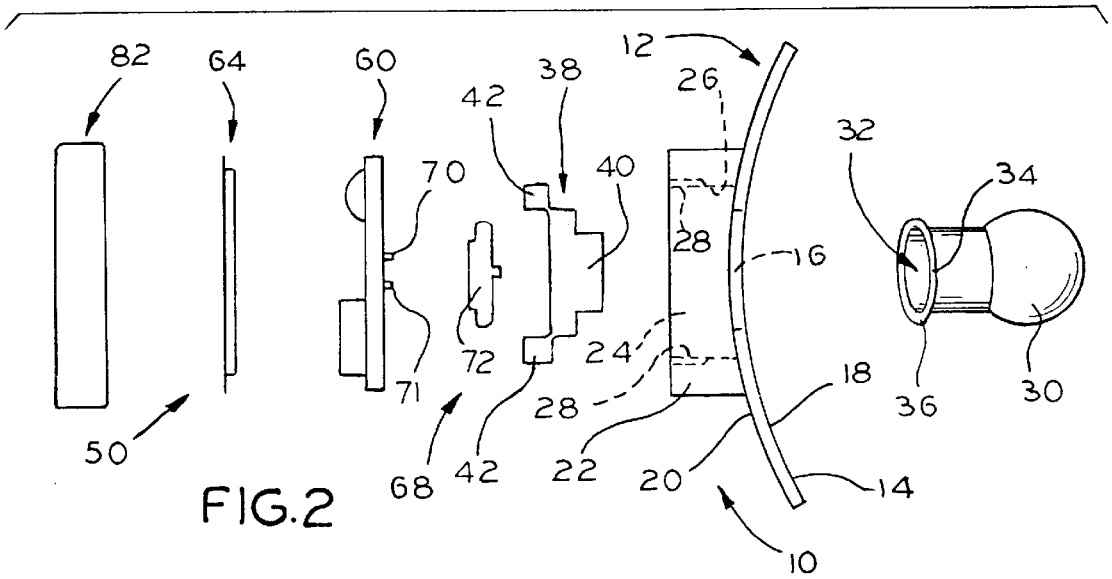
FIG. 2 is an exploded plan view of the pacifier of FIG. 1.

Referring to the drawings and more particularly FIGS. 1 and 2, there is shown generally at 10 a musical pacifier according to the present invention.

The pacifier 10 includes a mouthpiece 12. The mouthpiece 12 has a faceguard 14 with central opening 16. The faceguard 14 is of a conventional shape for pacifier faceguards having an inner surface 18 configured to be complementary to the face of an infant. Integrally connected to an outer surface 20 of the faceguard 14 is a generally cylindrical wall 22 defining a housing 24. The wall 22 is coaxial with the opening 16. The cylindrical wall 22 includes an inner cylindrical surface 26 having a pair of opposite notches 28 spaced 180° apart.

A nipple 30 of conventional shape has an interior space 32 accessible via an opening 34. An enlarged lip 36 is provided at the opening 34. As is conventional, the nipple 30 is of a flexible rubber-like material deformable due to sucking action of an infant. The nipple 30 is received in the mouthpiece opening 16. The lip 36 is of a size larger than the opening 16 to be loosely retained therein. With the nipple 30 mounted in the mouthpiece 12, the interior space 32 is in communication with the housing 24 through the central opening 16. A plug 38 secures the nipple 30 to the mouthpiece 12. Particularly, the plug 38 includes a head 40 of a size and shape corresponding generally to the nipple open end 34 to be received therein. Thus, the head 40 sandwiches the nipple 30 in the opening 16. The nipple 30 provides a seal between the plug 38 and faceguard 14. A wing 42 at each of opposite ends of the plug 38 are receivable in the housing notches 28 to maintain proper orientation of the plug 38. Owing to this construction, the plug 38 floats within the housing 24, along an axial center line of the housing 24.

Figure 3:
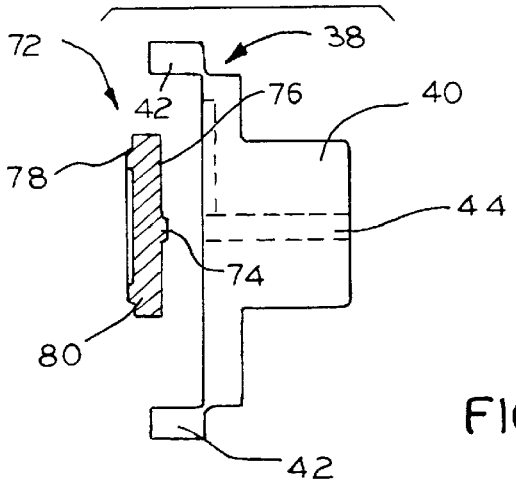
FIG. 3 is an exploded view, partially in section, of a plug and diaphragm of the pacifier of FIG. 1 illustrating an air bypass path.

As particularly shown in FIG. 3, the plug 38 includes an axial opening 44. With the plug 38 mounting the nipple 30 to the mouthpiece 12, the opening 44 defines a narrowed air passage from the nipple interior space 32 to the housing 24. A groove 46 is formed on an outer side of the plug 40 in communication with the central opening 44 and ending near one of the wings 42, for reasons discussed more particularly below.

Figure 5:
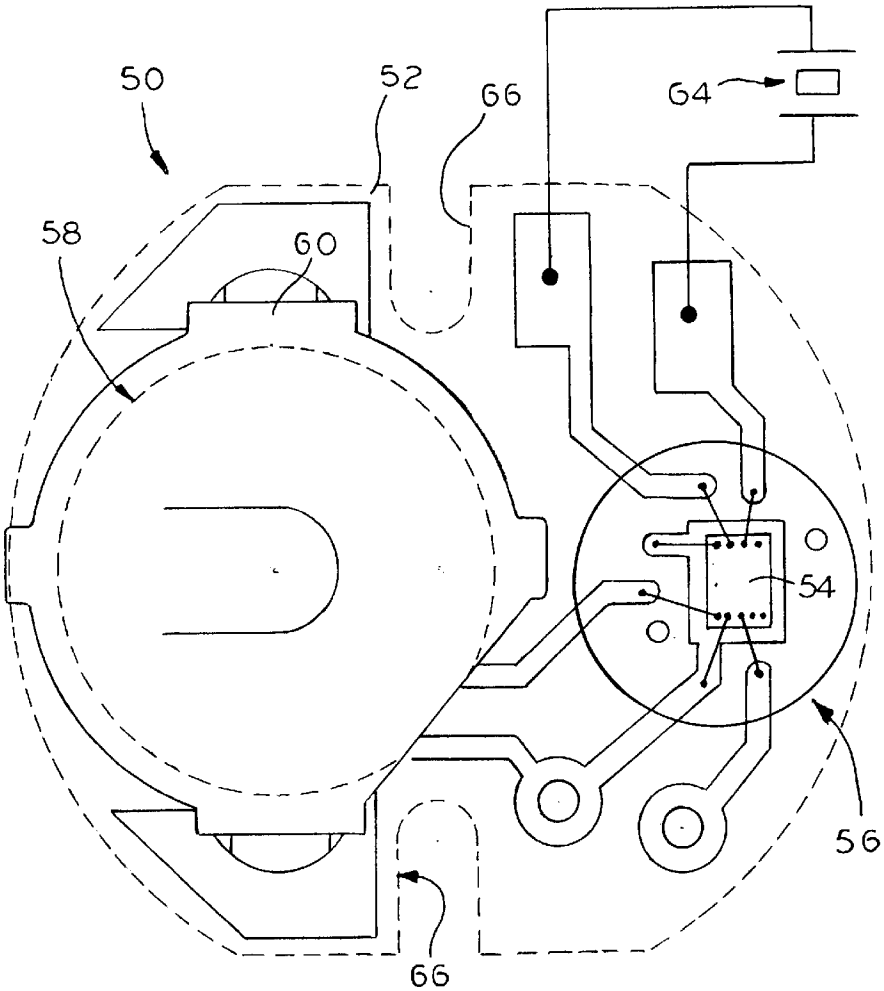
FIG. 5 is a top plan view of the printed circuit board of FIG. 4.
Figure 4:
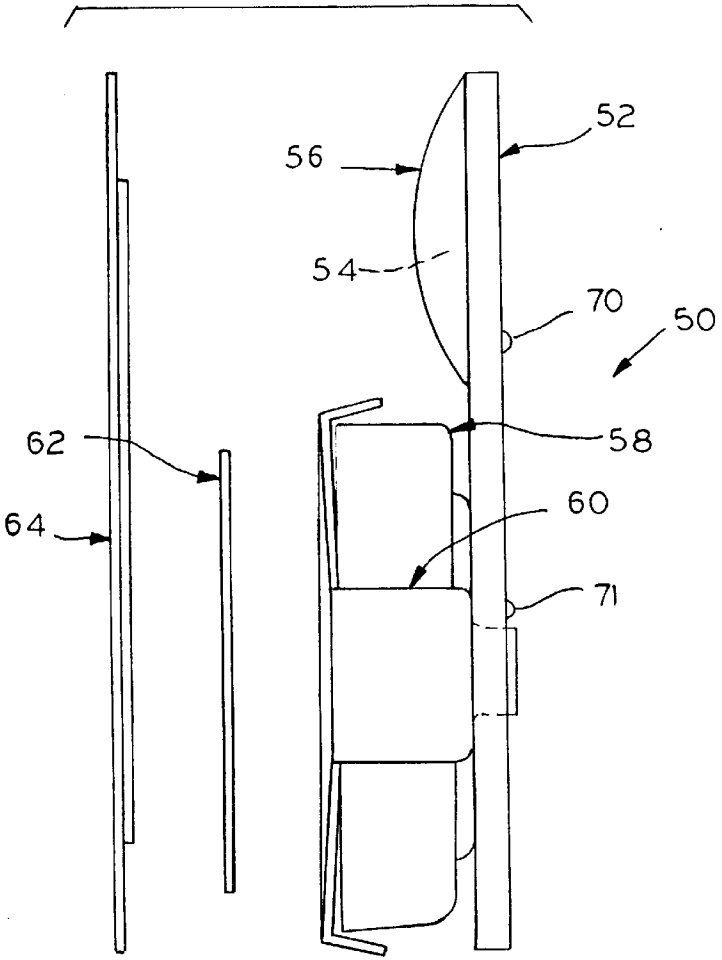
FIG. 4 is a partial exploded view illustrating details of an electronic sound generating circuit of the pacifier of FIG. 1.

Referring also to FIGS. 4 and 5, a switch-actuated sound generating circuit 50 is disposed in the housing 24 for controllably reproducing audio signals. The circuit 50 comprises a printed circuit board 52 supporting a programmed integrated circuit 54 sealed with a glob of epoxy 56. Power is provided by a battery 58 secured to the circuit board 52 with a conventional battery clip 60. A strip of double-sided tape 62 secures a piezo speaker 64 to the battery clip 60 and electrically insulates the two from each other. The speaker 64 is electrically connected to the integrated circuit 54 as generally illustrated in FIG. 5. The printed circuit board 52 includes opposite notches 66 for aligning the printed circuit board 52 in the housing 24 as by receiving the wings 42 to center the circuit board 52 and prevent movement.

The switch-actuated sound generating circuit 50 is electrically actuated by a pressure sensitive switch 68. The pressure sensitive switch 68 comprises fixed electrical contacts, represented at 70 and 71 on the inside of the circuit board 52, and a movable diaphragm switch 72. The diaphragm switch 72 is typically manufactured of conductive silicone rubber and is generally circular in shape. The switch 72 includes a central protrusion 74 on an inside surface 76 and an annular raised ridge 78 on an outer surface 80. The diaphragm switch 72 is sandwiched between the circuit board 52 and the plug head 40. Particularly, the raised ridge 78 maintains the diaphragm switch 72 spaced from the contacts 70 and 71. The protrusion 74 is received in the plug opening 44 to maintain the diaphragm switch 72 in a central axial position. The size of the protrusion 74 is selected to be received in the opening 44 without sealing the opening 44 relative to the channel 46. As can be seen, the length of the channel 46 is greater than the radius of the diaphragm switch 72 so that even with the diaphragm switch 72 seated on the plug head 40 there is an air leakage path from the opening 44 into the housing 24.

Figure 6:
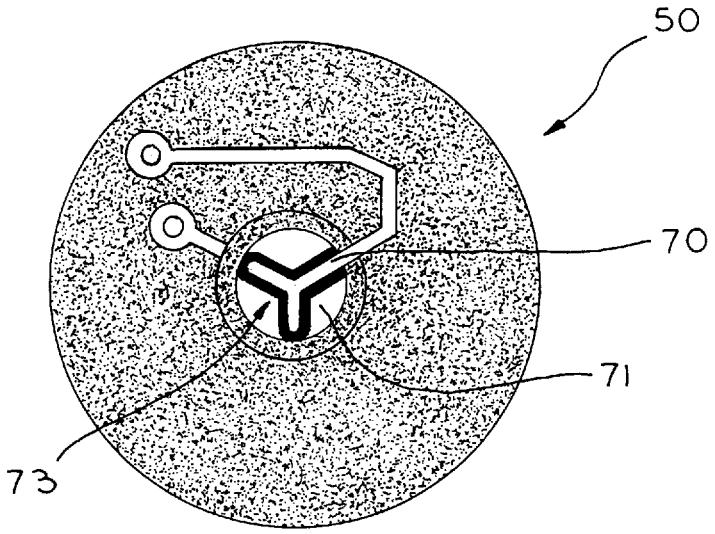
FIG. 6 is a bottom plan view of the printed circuit board of FIG. 4 illustrating electrical contacts that form part of a diaphragm switch.

Referring to FIG. 6, the bottom of the circuit board 52 is illustrated. The contact 70 comprises a Y-shaped conductive trace on the board 52. The contact 71 comprises a contact pad which is generally circular and surrounds the Y-shaped contact 70 without contacting the same. The circuit board 52 is covered with a solder mask except for an annular area represented at 73 so that only a portion of the contacts 70 and 71 are exposed. The solder mask elevates the switch 72 to prevent inadvertent actuation of the contacts 70 and 71 by the conductive switch 72.

A cap 82 is received on the housing 24. The cap 82 maintains the speaker 64, circuit board 52, diaphragm switch 72 and plug 38 within the housing 24. Particularly, the cap 82 and mouthpiece 12 are of polycarbonate construction. The cap 82 is sonically welded onto the cylindrical wall 22 to provide an airtight and watertight seal. By fusing the cap 82 to the wall 22, the plug 38 is effectively fused in place in a desired central position. Likewise, the nipple 30 acts as a gasket between the plug 38 and the mouthpiece 12 to provide a further airtight and watertight construction.

The particular operation and programming of the sound generating circuit 50 is not critical to the claimed invention. The circuit may be generally similar in operation to that described in U.S. Pat. No. 4,554,919 and is operable to reproduce audio signals, such as a musical tune, for a period of time after contact is made between the contacts 70 and 71 by the diaphragm switch 72.

Normally, i.e., in the shelf state, the diaphragm switch 72 generally closes the air passage 44 so that the switch 72 is spaced from the contacts 70 and 71. The air channel 46 being in communication with the housing 24 and the passage 44 maintains static pressure equilibrium between the nipple interior space 32 and the housing 24. When the nipple 30 is collapsing, as by the infant sucking, a dynamic pressure change occurs in the nipple interior space 32 to force the diaphragm switch 72 against the contacts 70 and 71 to actuate the sound generating circuit 50 to play a musical tune on the speaker 64. When the nipple 30 has finished collapsing, the pressure difference across the diaphragm switch 72 is relieved via the air channel 46 and the diaphragm switch 72 will then return to its normal position. A similar equalizing action occurs again after the nipple 30 is released.

Because the pacifier 10 is of watertight and immersion proof construction, the electronic circuitry need not be removed if the pacifier 10 is immersed in water, such as for boiling, dishwashing or sterilization. The use of the air channel 46 prevents damage from a large differential pressure across the switch 72 such as might occur during boiling, dishwashing or sterilization. Moreover, the air channel 46 prevents switch bias due to changes in ambient pressure and temperature. This is accomplished as the channel 46 acts as a slow bypass path from one side of the switch 72 to the other. A large pressure developing on one side of the switch is relieved to the other side, preventing a large differential pressure from developing. Therefore, the switch 72 will not rupture. Likewise, the bypass path acclimates any change in atmospheric pressure, temperature or altitude, preventing a bias from forming on the switch 72. A bias on the switch 72 could make activation by the infant more difficult, or the switch 72 could be activated inadvertently for long periods of time, leading to premature battery failure.

Figure 7:
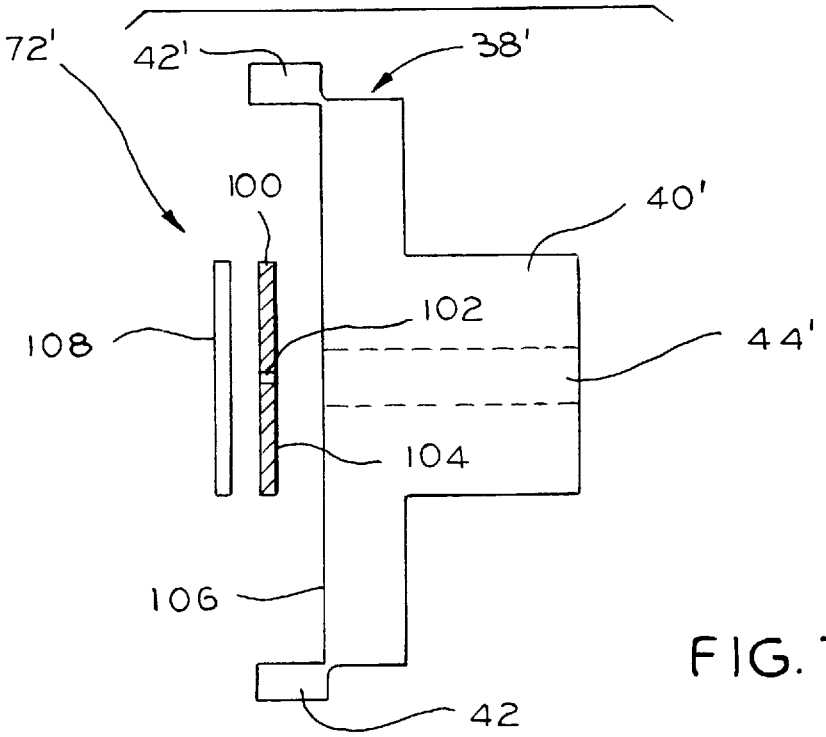
FIG. 7 is an exploded view, partially in section, similar to FIG. 3 of an alternative plug and diaphragm illustrating an alternative air bypass path.

Referring to FIG. 7, a switch arrangement according to an alternative embodiment of the invention is illustrated. In this embodiment, elements which correspond generally to elements of FIG. 3 are referenced with like, primed reference numerals and are therefore described in detail.

In the alternative embodiment, the plug 38' is similar to the plug 38, see FIG. 3, omitting the groove 46. The diaphragm switch 72' consists of a film or membrane 100 having a central through opening 102. A back side of the membrane 100 has an adhesive surface 104 for adhering the membrane 100 to an outer surface 106 of the plug 38'. In so doing, the opening 102 is positioned overlying the plug opening 44'. A conductive element 108 is outside the membrane 100 and is sandwiched by the membrane 100 and the printed circuit board 52 (not shown in this Figure).

In the alternative embodiment, the opening 102 provides an air leakage or bypass path eliminating the use of the channel 46. Normally, i.e., in the shelf state, the membrane 100 acts as a diaphragm to generally close the air passage 44', except for the small bypass opening 102. The opening 102 being in communication with the housing 24 and the passage 44' eliminates any static pressure differential across the membrane 100. When the nipple is collapsing, as by an infant sucking, a dynamic pressure change occurs in the nipple interior space to cause the membrane 100 to balloon outwardly against the conductive member 108, causing it to make contact with the contacts 70 and 71 to actuate the sound generating circuit 50 which plays a tune on the speaker 64. Once the membrane 100 comes into contact with the conductive member 108, the opening 102 is substantially closed so that the diaphragm switch 72' acts as a "leaky" one-way valve, increasing switch sensitivity but allowing eventual equalization. When the nipple 30 has finished collapsing, the pressure difference across the membrane 100 is relieved via the opening 102 and the membrane 100 and conductive member 108 will then return to their normal positions. Similarly, when the nipple is released, the pressure difference that has developed across the membrane 100 will also be relieved via the opening 102, returning membrane 100 and conductive member 108 to their normal positions. Although shown as separate elements, the membrane 100 could be a conductive membrane or could have a conductive element adhered directly thereon such as by sputtering or the like.

Thus, the invention broadly comprehends a musical pacifier incorporating a slow air bypass path to prevent damage from a large differential pressure across the switch and to prevent switch bias due to changes in ambient pressure and temperature.

I claim:

1. A pacifier comprising:

a mouthpiece including a faceguard having an opening defining an air passage to an integral housing;

a nipple mounted to the mouthpiece and having an interior space in communication with the housing through said air passage;

a switch actuated sound generating circuit disposed in said housing for controllably reproducing audio signals;

a pressure sensitive switch normally generally closing said air passage, said switch electrically actuating said sound generating circuit in response to pressure generated in the nipple causing the switch to open the air passage and subsequently normally generally closing the air passage when the pressure is relieved; and means defining an air leakage path between said nipple interior space and said housing to maintain static pressure equilibrium between the nipple interior space and the housing.

2. The pacifier of claim 1 wherein said switch comprises a diaphragm switch.

3. The pacifier of claim 2 wherein said diaphragm switch comprises a flexible, electrically conducting element spaced a select distance from contacts associated with the sound generating circuit.

4. The pacifier of claim 3 wherein said element includes a raised annular ridge normally spacing the element from the contacts.

5. The pacifier of claim 1 wherein said housing comprises a sealed housing.

6. The pacifier of claim 1 further comprising a plug securing said nipple in the opening of the mouthpiece.

7. The pacifier of claim 6 wherein said plug extends through the faceguard opening and includes a through opening defining a narrowed air passage between the nipple and the housing normally closed by the switch and said air leakage means comprises a channel in said plug defining a bypass path around the switch.

8. The pacifier of claim 1 wherein said air leakage means comprises a through opening in said switch.

9. A watertight, immersion proof pacifier comprising:

a mouthpiece including a faceguard having an opening defining an air passage to an integral sealed housing;

a nipple having an interior space;

means for sealingly mounting the nipple to the mouthpiece with the interior space in communication with the housing through said air passage;

a switch actuated sound generating circuit disposed in said hosing for controllably reproducing audio signals;

a pressure sensitive switch normally generally closing said air passage, said switch electrically actuating said sound generating circuit in response to pressure generated in the nipple causing the switch to open the air passage and subsequently normally generally closing the air passage when the pressure is relieved; and means defining an air leakage path between said nipple interior space and said housing to maintain static pressure equilibrium between the nipple interior space and the housing.

10. The pacifier of claim 9 wherein said switch comprises a diaphragm switch.

11. The pacifier of claim 10 wherein said diaphragm switch comprises a flexible, electrically conducting element spaced a select distance from contacts associated with the sound generating circuit.

12. The pacifier of claim 11 wherein said element includes a raised annular ridge normally spacing the element from the contacts.

13. The pacifier of claim 9 wherein said mounting means comprises a plug securing said nipple in the opening of the mouthpiece.

14. The pacifier of claim 13 wherein said plug extends through the faceguard opening and includes a through opening defining a narrowed air passage between the nipple and the housing normally closed by the switch and said air leakage means comprises a channel in said plug defining a bypass path around the switch.

15. The pacifier of claim 9 wherein said air leakage means comprises a through opening in said switch.

16. A pacifier comprising:

a mouthpiece including a faceguard having an opening defining an air passage to an integral housing;

a nipple mounted to the mouthpiece and having an interior space in communication with the housing through said air passage;

an electrically actuable circuit disposed in said housing;

a pressure sensitive switch normally generally closing said air passage, said switch electrically actuating said circuit in response to pressure generated in the nipple causing the switch to open the air passage and subsequently normally generally closing the air passage when the pressure is relieved; and means defining an air leakage path between said nipple interior space and said housing to maintain static pressure equilibrium between the nipple interior space and the housing.

17. The pacifier of claim 16 wherein said switch comprises a diaphragm switch.

18. The pacifier of claim 17 wherein said diaphragm switch comprises a flexible, electrically conducting element spaced a select distance from contacts associated with the sound generating circuit.

19. The pacifier of claim 16 wherein said housing comprises a sealed housing.

20. The pacifier of claim 16 further comprising a plug extending through the faceguard opening and securing said nipple in the opening of the mouthpiece, the plug including a through opening defining a narrowed air passage between the nipple and the housing normally closed by the switch and said air leakage means comprises a channel in said plug defining a bypass path around the switch.

21. The pacifier of claim 16 wherein said air leakage means comprises a through opening in said switch.

22. A pacifier comprising:

a mouthpiece including a faceguard having a nipple portion defining an interior space;

a housing secured to the mouthpiece;

a switch actuated electronic circuit disposed in said housing:

a pressure sensitive diaphragm switch in communication with the interior space of said nipple portion for actuating said circuit in response to pressure generated in the nipple portion; and means defining an air leakage path to maintain static pressure equilibrium on said pressure sensitive diaphragm switch.

* * * * *